US005953752A

United States Patent [19]

Jones

[11] Patent Number: 5,953,752

[45] Date of Patent: Sep. 21, 1999

[54] HAND, WRIST AND FOREARM PROTECTOR

[76] Inventor: Troy Jones, 6658 Gambol Quail Dr. East, Colorado Springs, Colo. 80918

[21] Appl. No.: 09/129,355

[22] Filed: Aug. 5, 1998

[51] Int. Cl.[6] ..... A41D 13/08

[52] U.S. Cl. ..... 2/16; 2/161.1; 128/878

[58] Field of Search ..... 2/16, 20, 21, 22, 2/159, 160, 161.1, 162; 602/20, 21, 22, 62, 64, 5; 128/877, 878, 879

[56] References Cited

U.S. PATENT DOCUMENTS

| | | | |
|---|---|---|---|
| D. 319,113 | 8/1991 | Adams | D29/20 |
| D. 385,669 | 10/1997 | Oetting | D29/120 |
| D. 392,072 | 3/1998 | Levine | D29/120 |
| 3,746,356 | 7/1973 | Shipstad | 2/16 |
| 3,855,633 | 12/1974 | Rhee | 2/161.1 |
| 3,903,546 | 9/1975 | Rhee | 2/16 |
| 4,361,912 | 12/1982 | Arthur | 2/16 |
| 4,984,300 | 1/1991 | Cho | 2/161.1 |
| 5,018,221 | 5/1991 | Romandetto | 2/16 |
| 5,205,812 | 4/1993 | Wasserman | 602/878 |
| 5,313,667 | 5/1994 | Levine | 2/16 |
| 5,413,120 | 5/1995 | Grant | 128/877 |
| 5,454,380 | 10/1995 | Gates | 128/879 |
| 5,458,564 | 10/1995 | Franzen | 2/16 |
| 5,526,531 | 6/1996 | Olson et al. | 2/16 |
| 5,537,692 | 7/1996 | Dorr | 2/161.1 |
| 5,566,389 | 10/1996 | Li | 2/16 |
| 5,652,955 | 8/1997 | Skewis | 2/20 |
| 5,685,013 | 11/1997 | Hausman | 2/16 |
| 5,722,092 | 3/1998 | Borzecki et al. | 2/16 |
| 5,772,620 | 6/1998 | Szlema et al. | 602/21 |

FOREIGN PATENT DOCUMENTS

| | | |
|---|---|---|
| 4406066 | 7/1994 | Germany . |
| 52-8340 | 1/1977 | Japan . |

*Primary Examiner*—John J. Calvert
*Assistant Examiner*—Tejash D Patel
*Attorney, Agent, or Firm*—Dale B. Halling

[57] ABSTRACT

The invention relates to a hand, wrist and forearm protector for use during sporting activities, in particular, snowboarding. The protector is a unitary piece or shell which encloses a hand, wrist and forearm of a user; thus, providing protection against injury to the user's hand, fingers, wrist and forearm, such as breakage, sprain, strain, bruising or hyperextension. The protector also prevents excessive wear and tear to a snowboarder's clothing, in particular, gloves and jacket sleeves. The invention may also be used for something to sit on during a rest period of the user.

19 Claims, 5 Drawing Sheets

HAND, WRIST AND FOREARM PROTECTOR

FIELD OF THE INVENTION

The invention relates to a hand, wrist and forearm protector for use during sporting activities, in particular, snowboarding.

BACKGROUND OF THE INVENTION

In the sport of snowboarding, the hand, wrist and forearm of a snowboarder are particularly susceptible to injury. Since snowboarders do not use poles, as do alpine skiers, they often place their hands on the snow as a focal point for executing various maneuvers. As such, their hands, wrists and forearms are subject to impact forces and the like which often result in injury to the snowboarder's hand, fingers, wrist and forearm, such as breakage, sprain, strain, bruising or hyperextension. Additionally, the snowboarder's gloves and jacket sleeves are subjected to excessive wear and tear necessitating frequent repair or replacement of the same.

In the prior art, there is no article suitable for wear by a snowboarder which would protect him or her from the aforementioned injuries or clothing wear. There are some prior art devices which are designed to protect a user's wrist and forearm, such as in the sports of in-line skating, skate boarding and the like; however, there are no prior art devices suitable for protection of a snowboarder's hand, wrist and forearm and clothing. A few of the representative prior art devices are discussed below.

U.S. Pat. No. D 319,113 by Adams, issued Aug. 13, 1991, for a "Combined Mitten Retainer and Wrist Protector" generally discloses a design for a soft shell wrist gator. However, it does not provide protection to the user's hand and fingers, wrist and forearm against injury.

U.S. Pat. No. D 385,669 by Oetting, issued Oct. 28, 1997, for a "Wrist Protector" generally discloses a design for a rigid, two piece wrist protector. This design does not provide protection for a user's fingers or forearm.

U.S. Pat. No. D 392,072 by Levine, issued Mar. 10, 1998, for a "Snowboard Wrist Protector" generally discloses a design for a wrist protector which is comprised of a soft shell casing with rigid plates therein along dorsal and palmar longitudinal axes of a user's forearm. Likewise, this design does not provide protection for a user's fingers or forearm.

U.S. Pat. No. 5,313,667 by Levine, issued May 24,1994, for a "Snowboard Wrist Protector" generally discloses a wrist pad which comprises an elastic body portion defined by an inner and outer surface which is bounded by a plurality of elongated side edges, the body portion having integral means for lending structural rigidity to the entire pad assembly, the structural rigidity means comprising an elongated semi-rigid support member having a profile approximating the wrist-hand junction of a wearer, and a plurality of opposing flaps and straps having alternate faces of hook and loop material respectively, thereby forming a releasable securable structure around the user's wrist. However, this wrist protector does not provide protection for a user's fingers or forearm.

U.S. Pat. No. 5,526,531 by Olson et al., issued Jun. 18, 1996, for a "Wrist Guard" generally discloses a wrist guard which has a molded body having its first end configured to contact a user's palm and a second end configured to engage the user's forearm. A thumb receiving member is located at a first side of the palm end of the wrist guard and is designed to prevent overextension of the thumb. The forearm portion stabilizes the wrist guard so it does not rotate. The first strap extends between the thumb covering and the opposing side of the first end of the palm and of the stiff body member. This strap is selectively adjustable to ensure proper fit. A second strap is located at the forearm end of the wrist guard. This strap, like the first strap, is selectively adjustable to ensure proper fit. The user will insert his or her thumb into the thumb receiving member and tighten the straps for securing the wrist guard.

U.S. Pat. No. 5,537,692 by Dorr, issued Jul. 23, 1996, for a "Snowboard Glove with Wrist Protection" generally discloses a snowboard glove which provides protection to the hand and wrist of the wearer, but not to the wearer's forearm. The glove includes a shell having a wrist portion, a palm portion, a back-of-hand portion, a thumb portion and a fingers portion. The glove is provided with a first elongated pouch on the palm portion of the glove and a second elongated pouch on the back-of-hand portion for respectively receiving a palm wrist support plate and a back-of-hand wrist support plate.

U.S. Pat. No. 5,566,389 by Li, issued Oct. 22, 1996, for a "Shock Absorbing Wrist Guard" generally discloses a shock-absorbing wrist guard which includes a soft piece including two ear portions, a loop pile area connected, on a portion of the soft piece, an envelope connected to another portion of the soft piece and defining a plurality of slots therein, a mediate portion between the loop pile area and the envelope, an opening defined in the space portion allowing a thumb of a user to, pass therethrough, and a soft strip extended from one side of the loop pile area, and a shock absorbing device received in the envelope for protecting the user's wrist. The shock-absorbing device includes a flat plate, two wings extended from the flat plate, an arcuate portion bridged above a portion of the flat plate which is located between the two wings, thus defining a space between the arcuate portion and the flat plate, a plurality of cushion elements being formed in the space and connected between the arcuate portion and the flat plate portion which is between the arcuate portion and the flat plate portion which is between the two wings for absorbing an external reactive force transmitted through the arcuate portion. However, this device does not provide protection against injury to the user's hand, fingers and forearm.

U.S. Pat. No. 5,652,955 by Skewis, issued Aug. 5, 1997, for a "Wrist Protector" generally discloses a hand and wrist protector for skaters which has two rigid formed plates which are securely strapped to the wrist with wide hook and loop straps. A first plate extends from the wrist down to a palm portion with a concave inner surface and a hard abrasion resistant outer surface. A second plate extends from the wrist down to a dorsal hand portion with a convex inner surface which prevents hyperextension of the wrist joint. The inner surfaces are covered with a resilient moisture absorbing surface. The palm portion and dorsal hand portions are free of attachment at their anterior and lateral edges so that the thumb and fingers are unrestrained and perspiration is more readily evaporated. However, this device does not provide protection against injury to the user's hand, fingers and forearm.

U.S. Pat. No. 5,685,013 by Hausman, issued Nov. 11, 1997, for a "Hand, Wrist, and Forearm Protective Device" generally discloses a protective device for mitigating the risks and hazards of fractures and injuries to the wrist and forearm that is intended to be utilized by individuals who participate in skating activities or other sports played on hard surfaces. The device has semi-rigid splint members which are fastened above and below the wearer's forearm and extend from the palm area of the hand longitudinally along the forearm toward the elbow. The palm area of the device includes an arched portion of the splint member which defines a space for containing a shock absorber which cushions the impact of a fall, thereby alleviating the extent of injury to the wrist and forearm areas. The palm area also includes a spring for transmitting the force of a fall along the extremity of the forearm splint members land the palmar portion of the protective device. In a preferred embodiment of the invention, splint members which lie along the palmar area of the forearm, slide relative to each other for additional impact and injury mitigation. However, this device does not provide protection against injury to the user's fingers.

U.S. Pat. No. 5,722,092 by Borzecki et al., issued Mar. 3, 1998, for a "Protective Arm and Wrist Guard" generally discloses a protective guard for use during sports such as snowboarding. It comprises a substantially rigid dipartite sleeve adapted to receive the distal forearm, wrist and proximal portion of a hand; thumb receiving region at one end of the sleeve to receive and partially surround the base of the thumb of a user and retaining straps to hold the sleeve on the arm of a user. However, this device does not provide protection against injury to the user's fingers.

There is a need for a device which can provide protection to the hand, wrist and forearm of a snowboarder and which can prevent excessive wear and tear to a snowboarder's clothing, in particular, gloves and jacket sleeves. The invention is a unitary piece or shell which encloses a hand, wrist and forearm of a user; thus, providing protection against injury, such as breakage, sprain, strain, bruising or hyperextension, to the user's hand, fingers, wrist and forearm and which prevents excessive wear and tear to a users'clothing. The invention may also be used for something to sit on during a rest period of the user.

SUMMARY OF THE INVENTION

In one embodiment, the invention comprises a hand, wrist and forearm protector comprising a unitary shell; comprising a hand section; contiguous with a forearm section; a grip which traverses the hand section; and at least one fastener; wherein the hand section encloses a hand of a user and the hand of the user is enclosed about the grip to form a fist; further wherein the hand section has a thumb opening and a knuckle opening therein; further wherein the forearm section encloses a forearm of a user by means of an overlap section of the forearm section which is lapped over an underlap section of the forearm section and the overlap section is fastened upon the underlap section by at least a fastener; and further wherein a distal end of the unitary shell is closed with an end cap.

In an alternative embodiment of the invention comprises a hand, wrist and forearm protector comprising a unitary shell; comprising a hand section; contiguous with a forearm section; a grip which traverses the hand section; and at least one fastener; wherein the hand section encloses a hand of a user and the hand of the user is enclosed about the grip to form a fist; further wherein the hand section has a thumb opening, a knuckle opening and a finger opening therein; further wherein the forearm section encloses a forearm of a user by means of an overlap section of the forearm section which is lapped over an underlap section of the forearm section and the overlap section is fastened upon the underlap section by at least a fastener; and further wherein a distal end of the unitary shell is open and a roll bar spans the distal opening.

In either embodiment, the protector may further comprise a carrier opening in the 5 forearm section. Additionally, the grip and the inside of the unitary shell may be padded.

Also in either embodiment, the unitary shell may be constructed of a material selected from the group consisting essentially of flexible, impact resistant plastic; carbon fiber; and aluminum. The grip is preferably constructed of a low temperature conduction material.

DETAILED DESCRIPTION OF THE INVENTION

Figure 1:
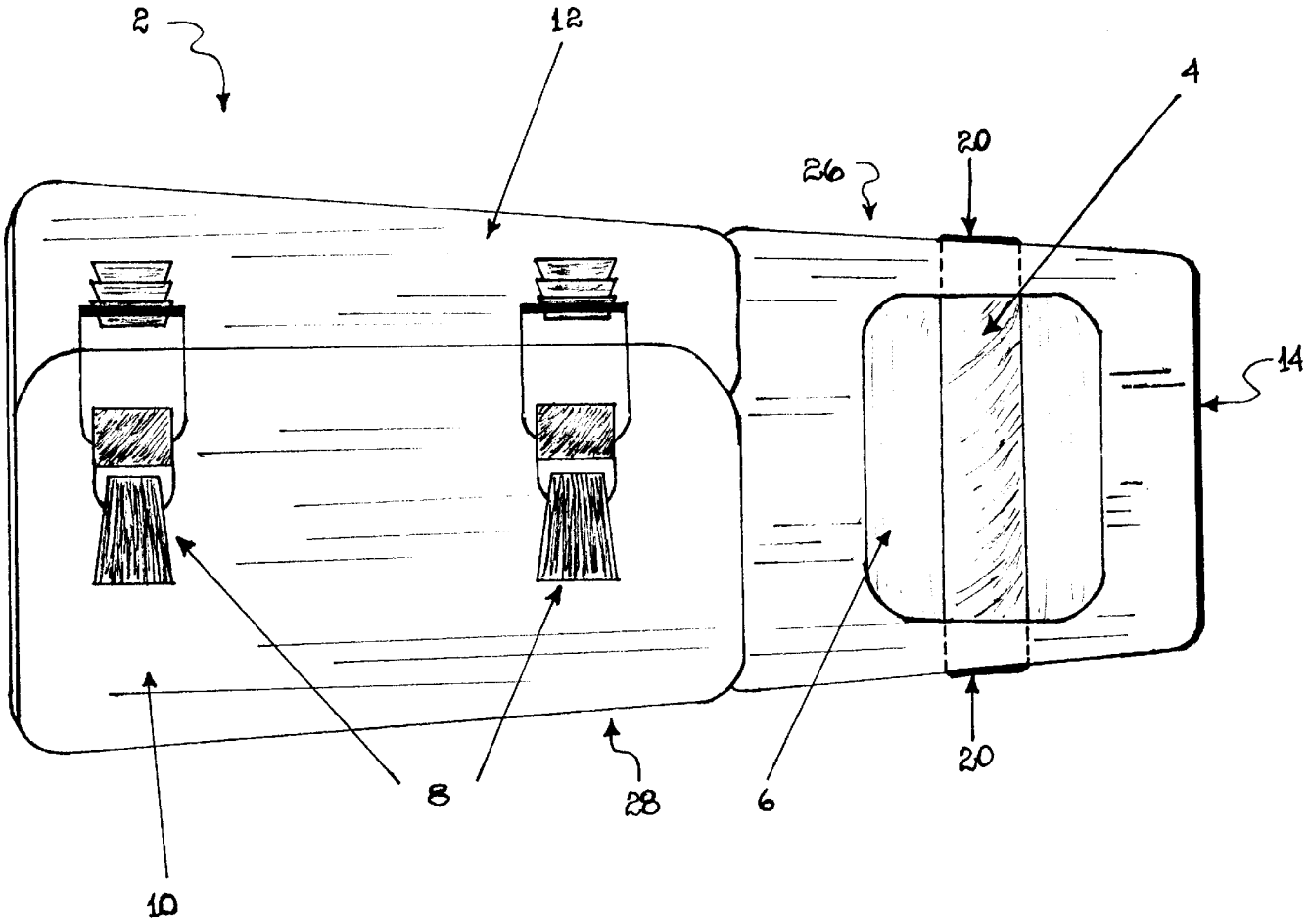
FIG. 1 is a top plan view of the outer arm side of the protector for the left arm.

The protector of the invention provides hand, finger, thumb, wrist and forearm protection for snowboarding or skating sports. The protector is preferably comprised of a unitary piece or shell. The protector has two sections, a hand section and a forearm section.

The forearm section is comprised of a wrap-around configuration such that when the protector is worn by a user, a forearm overlap laps over a forearm underlap and the protector is secured upon the user by means of a fastener which fastens the forearm overlap over and upon the forearm underlap. The fastener may be any suitable fastener such as a buckle, hook and loop tape, laces, snaps, straps and the like. The forearm overlap and forearm underlap allow for the protector to be splayed open and the user's hand and forearm to be slipped into the protector. The protector is then fastened upon the user with the desired and appropriate closure fit.

The hand section is a continuous piece which encircles the user's hand. Within the hand section is a grip. The grip is used by the user to wrap his or her fingers around the grip to create a fist within the protector. The formation of a fist about the grip insures that the protector stays in place during use and also allows for maximum protection of the user on impact, as a fist is the form in which the hand and fingers are best protected from injury. The grip is preferably made of wood or plastic or any other suitable low temperature conduction material, but not metal. A low temperature conduction material insures the comfort of the user by preventing extreme temperatures of cold and heat from being transmitted through the grip and to the hand of the user. Also, the grip is preferably padded for the comfort of the user. The padding may be of any suitable material, such as foam rubber, batting and the like.

The hand section also has a knuckle opening and a thumb opening within it. The thumb opening allows the user to have unrestricted access of the thumb and to provide mobility of the thumb. The knuckle opening relieves pressure of the protector on the knuckles and fingers of the user. The interior of the protector is preferably padded for the comfort of the user. The padding may be of any suitable material, such as foam rubber, batting and the like.

The material from which the protector is made must be able to hold up under stress and impact and to withstand freezing temperatures without being damaged or broken. Also, the protector is preferably made of a material that has a low temperature conduction to allow for maximum comfort of the user so as to not transfer the ambient temperature through the protector and to the user.

The protector of the invention can be made from any suitable flexible, yet strong, plastic; metal, such as aluminum; or carbon fiber. The protector may also be made of a combination of aluminum and plastic. In such an embodiment, the forearm section of the protector would be made of plastic and the hand section of the protector would be made of aluminum.

The protector may also optionally have a carrier opening on the inner arm side of the forearm section to serve as a carrier handle. Additionally, the carrier opening also serves to reduce the mass of the protector, thus, adding to user comfort.

The protector is closed at the hand or distal end by means of an end cap to provide maximum protection to the hand and fingers of a user. By having the hand and fingers enclosed, they are not exposed to injury, such as impact injury, but rather are protected by the protector which absorbs potential injury forces, such as impact force.

Competitive users of the protector will need to have unrestricted access to all digits of their hands in order to perform various maneuvers, such as jumps. Accordingly, in another embodiment of the invention, the protector has a distal opening at the distal end of the protector and a finger opening to allow for the fingertips of a user to be accessed and to be exposed outside of the protector. In this embodiment, the distal opening is spanned by a roll bar which serves to protect the hand and fingers of the user when the hand and fingers are in an enclosed position with a fist formed about the grip. As such, the fingers of the user are not exposed to injury, such as impact injury, but rather are protected by the roll bar of the protector, because the roll bar absorbs potential injury forces, such as impact force. In the alternative embodiment, the distal end opening and finger opening allow for a user to perform acrobatics, jumps and the like by enabling the user to extend his or her fingers from the protector in order to grab unto his or her snowboard.

In either embodiment of the invention, the protector may optionally have spikes, screws, cleats, or other suitable friction, grasping devices attached to the end cap or the roll bar. The friction, grasping devices are attached to the end cap or the roll bar in such a manner that the friction, grasping devices project outwardly from the protector. Preferably, the friction, grasping devices are equally spaced in relation to each other across the end cap area or the roll bar area; however, they may also be clustered together or non-equally spaced in relation to each other. The friction, grasping devices enable a user of the protector to place his or her fist down upon a surface over which he or she is traveling in order to gain a purchase thereon. By way of example only, a user of the protector for snowboarding may want to place his or her fist down upon a snow or ice surface in order to gain a purchase thereon and to enable him or her to perform maneuvers.

DETAILED DESCRIPTION OF THE DRAWINGS

The figures depict only the left arm version of the protector. However, as would be obvious to one of ordinary skill in the art, the protector comprises a left arm version and a right arm version, both of which would be worn by a user simultaneously on the left arm and the right arm, respectively. As would also be obvious, the right arm version is a mirror image of the left arm version. Accordingly, for illustrative and exemplary purposes, only the left arm version of the protector is illustrated and discussed herein.

FIG. 1 is a top plan view of the outer side of the protector 2 for the left arm. The protector 2 is comprised of a hand section 26 and a forearm section 28, which the hand section 26 and the forearm section 28 are contiguous with each other. The forearm section 28 overlaps upon itself to allow the protector 2 to be opened and an arm of a user to be slipped into the protector 2. Once the protector 2 is on, a forearm overlap 10 is lapped over a forearm underlap 12 and fastened in place with fasteners 8.

When the protector 2 is upon the forearm of the user, the user wraps his fingers around grip 4 to create a fist. The knuckles of the user are exposed through knuckle opening 6. The knuckle opening 6 allows for relief of pressure upon the user's hand when the protector 2 is being worn. The grip 4 is attached to the protector 2 by means of grip attachments 20. The hand section 26 of the protector 2 is enclosed at its distal end with an end cap 14.

Figure 2:
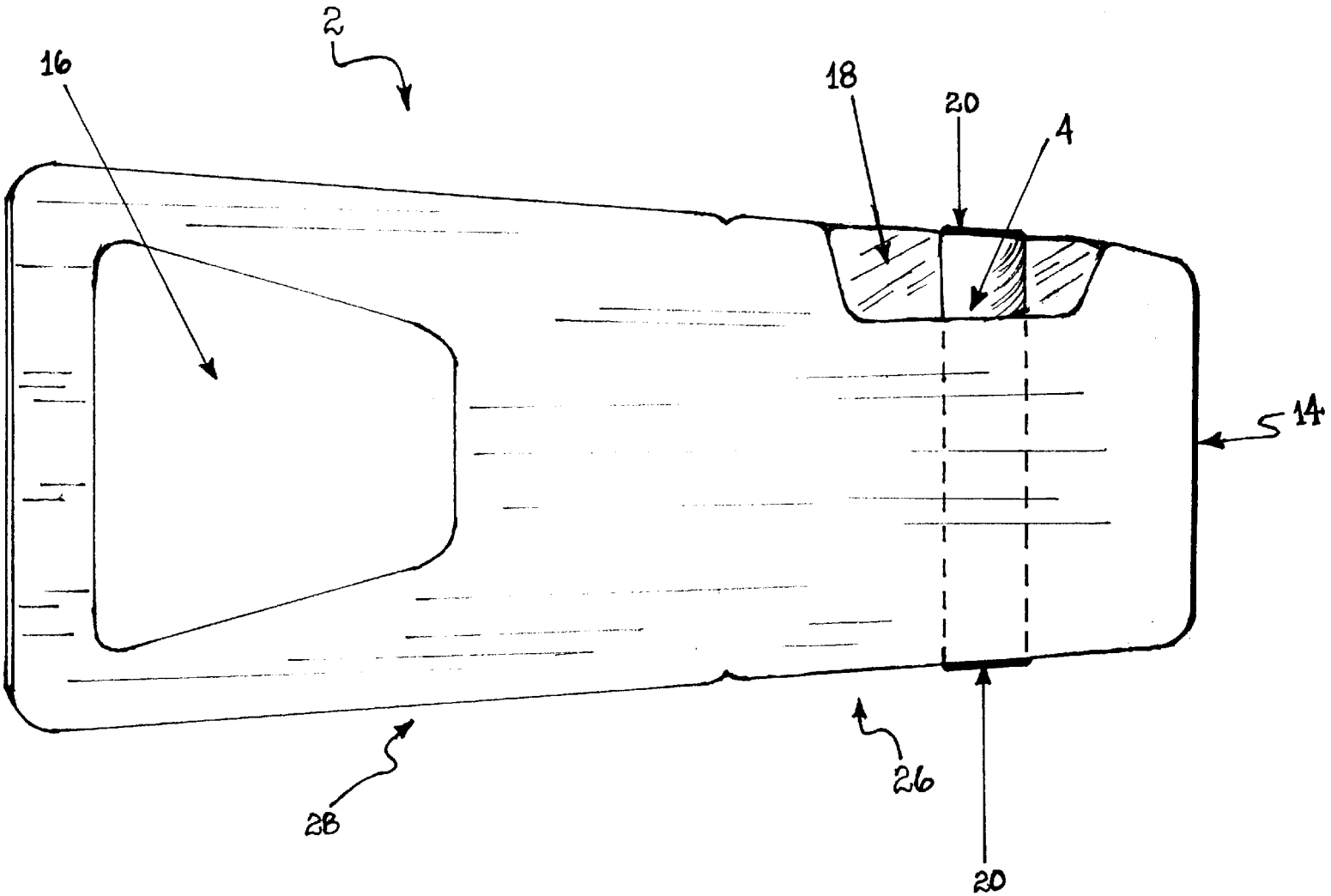
FIG. 2 is a bottom plan view of the inner arm side of the protector for the left arm.

FIG. 2 is a bottom plan view of the inner arm side of the protector 2 for the left arm. On the bottom side of the protector 2 is an optional carrier opening 16 which serves as a carrier handle when the protector 2 is not in use. Thumb opening 18 allows for relief of pressure upon the user's thumb when the protector 2 is being worn. The thumb opening 18 also allows for the user's thumb to be accessible for use.

Figure 3:
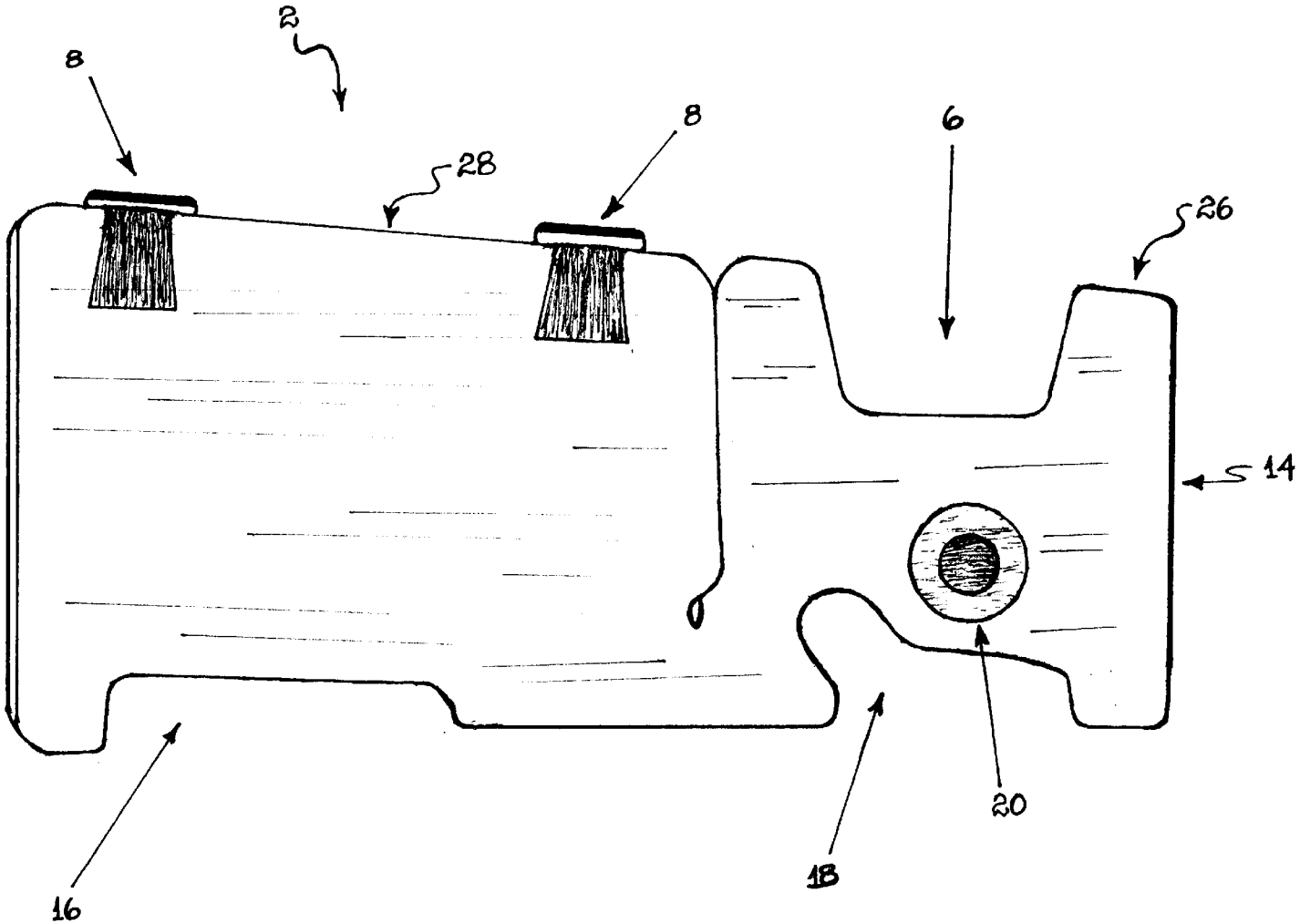
FIG. 3 is a side view of the medial or inner arm side of the protector for the left arm.

FIG. 3 is a side view of the medial or inner arm side of the protector 2 for the left arm. The thumb opening 18, knuckle opening 6 and the grip attachment 20 are visible on the hand section 26 of the protector 2. The carrier handle opening 16 and the fasteners 8 are visible on the forearm section 28 of the protector 2.

Figure 4:
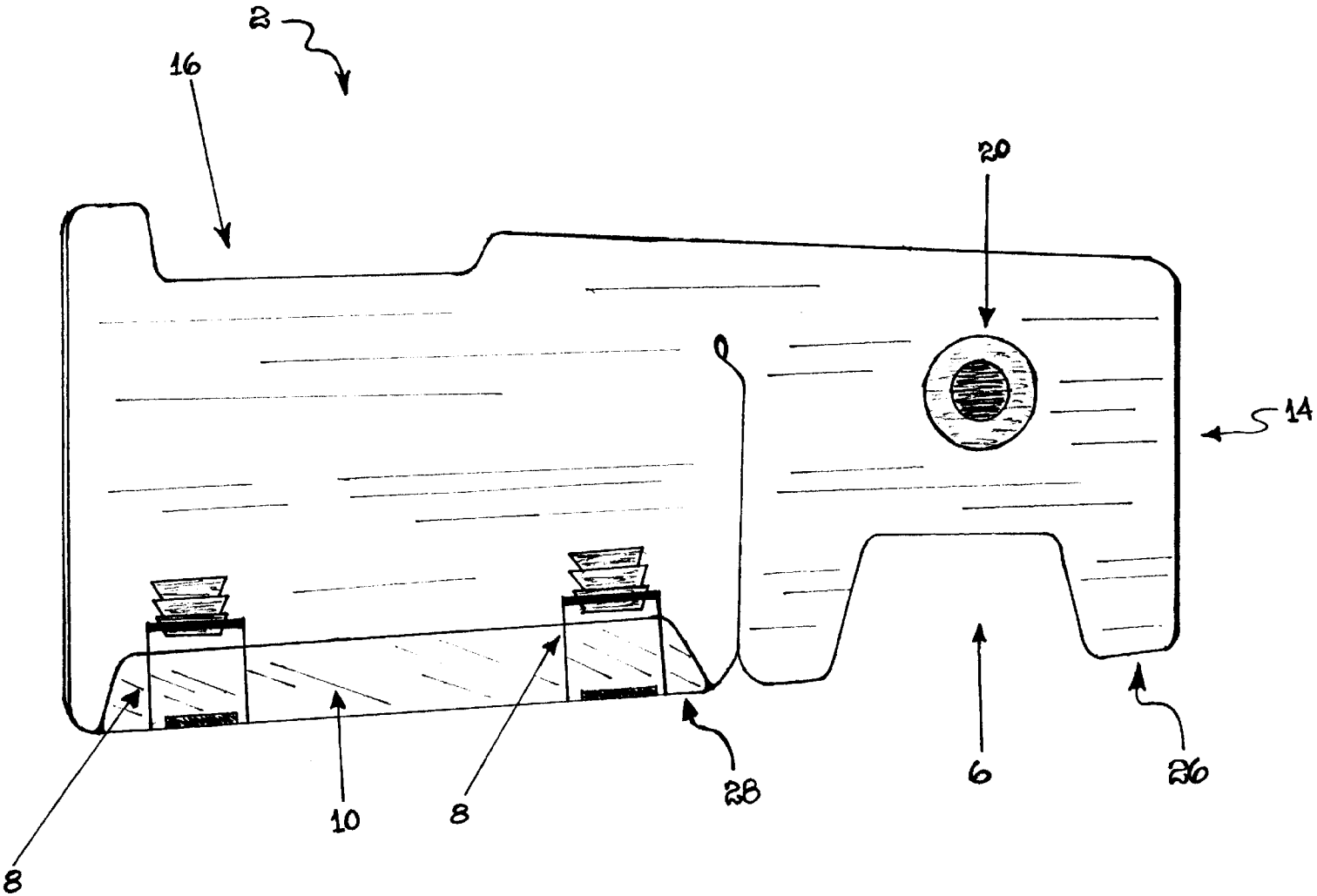
FIG. 4 is a side view of the lateral or outer arm side of the protector for the left arm.

FIG. 4 is a side view of the lateral or outer arm side of the protector for the left arm. The thumb opening 18, knuckle opening 6 and the grip attachment 20 are visible on the hand section 26 of the protector 2. The carrier opening 16 and the fasteners 8 are visible on the forearm section 28 of the protector 2. Forearm overlap 10 is shown as overlapping and fastened upon forearm overlap 12.

Figure 5:
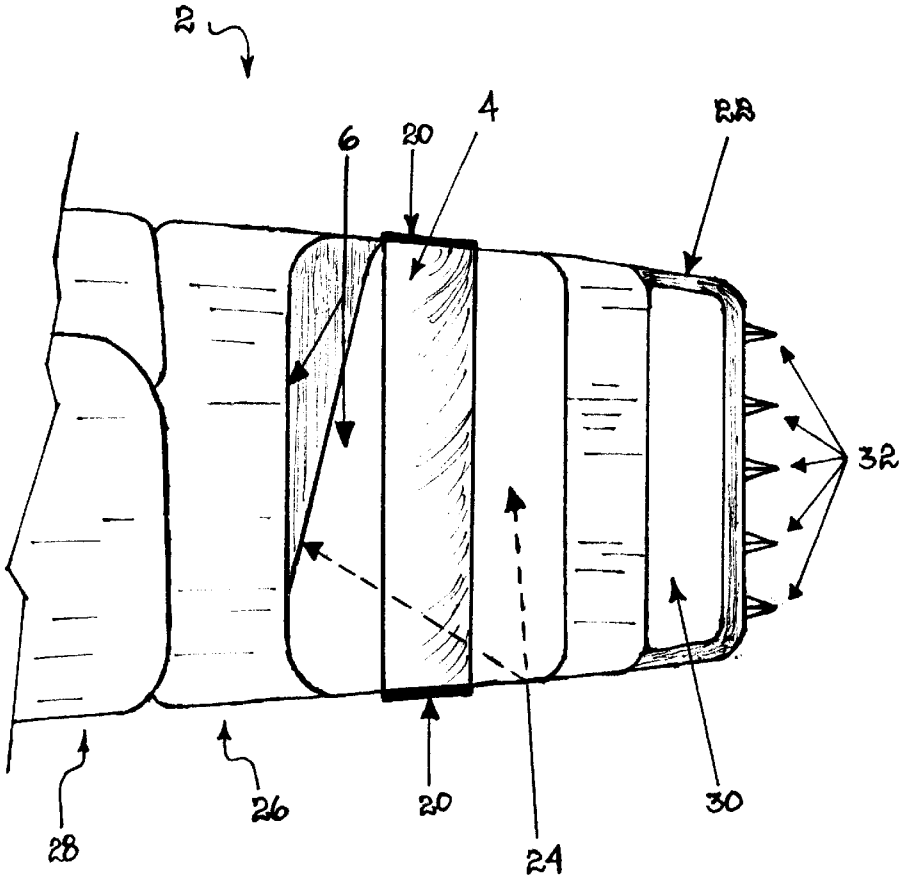
FIG. 5 is a cut away top plan view of the protector for the left arm in another embodiment of the invention.

FIG. 5 is a cut away top plan view of the medial or inner arm side of the protector 2 for the left arm in another embodiment of the invention. The protector 2 has a knuckle opening 6 and a roll bar 22. Distal opening 30 of hand section 26 of the protector 2 allows for the user's fingers to be protruded through distal opening 30. Finger opening 24 also allows the user to protrude his or her fingers therethrough. The user may protrude his or her fingers through distal opening 30 and finger opening 24 in order to perform various snowboard maneuvers, such as grabbing hold of his or her snowboard during jump maneuvers. Distal opening 30 also allows the user to have unrestricted access to the fingers of his or her hand. Distal opening 30 and finger opening 24 may or may not be contiguous with each other. Roll bar 22 protects the user's fingers from injury upon impact and the like when the user has his or her hand in an enclosed, fist position. Friction, grasping devices 32 enable a user to place his or her fist down upon a surface over which he or she is traveling in order to gain a purchase thereon.

Figure 6:
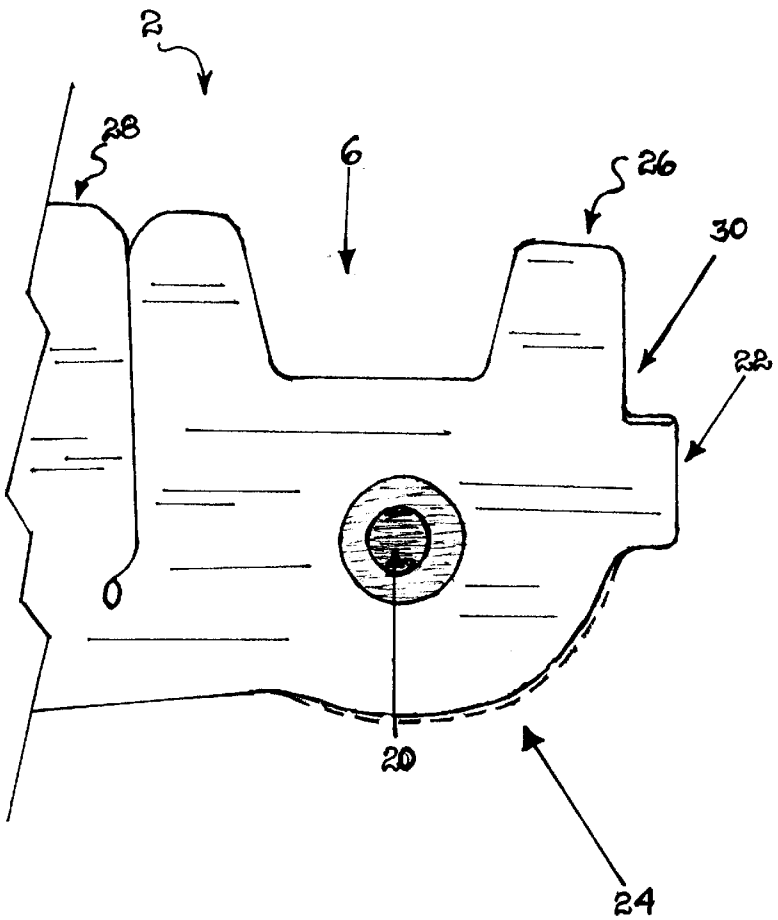
FIG. 6 is a cut away side view of the medial or inner arm side of the protector for the left arm in another embodiment of the invention.

FIG. 6 is a cut away side view of the medial or inner arm side of the protector for the left arm in another embodiment of the invention. The protector has a knuckle opening 6, a finger opening 24 and a roll bar 22. Finger opening 24 and distal opening 30 allow the user's fingers to protrude therethrough enabling the user to perform grabbing maneuvers.

The embodiments illustrated and discussed in the specification are intended only as exemplary and the many other feasible embodiments within the scope of this invention will be readily understood and appreciated by those having ordinary skill in the art. Nothing in the specification should be construed as limiting the scope of the invention. Many changes may be made by those having ordinary skill in the art to produce a highly effective hand, wrist and forearm protector without departing from the invention. Accordingly, the invention should be limited only by the claims.

I claim:

1. A hand, wrist and forearm protector comprising:

a. a unitary shell; comprising b. a hand section; contiguous with c. a forearm section;

d. a grip which traverses the hand section; and e. at least one fastener;

wherein the hand section encloses a hand of a user and the hand of the user is enclosed about the grip to form a fist;

further wherein the hand section has a knuckle opening further wherein the forearm section encloses a forearm of a user by means of an overlap section of the forearm section which is lapped over an underlap section of the forearm section and the overlap section is fastened upon the underlap section by at least a fastener.

2. A protector as claimed in claim 1, further comprising a carrier opening in the forearm section.

3. A protector as claimed in claim 1, further comprising a thumb opening in the hand section.

4. A protector as claimed in claim 1, wherein the unitary shell is constructed of a material selected from the group consisting essentially of flexible, impact resistant plastic; carbon fiber; and aluminum.

5. A protector as claimed in claim 1, wherein the grip is constructed of a low temperature conduction material.

6. A protector as claimed in claim 1, wherein the grip and the inside of the unitary shell are padded.

7. A protector as claimed in claim 1, wherein a distal end of the unitary shell is closed with an end cap.

8. A protector as claimed in claim 1, wherein a distal end of the unitary shell is open.

9. A hand, wrist and forearm protector comprising:

a. a unitary shell; comprising b. a hand section; contiguous with c. a forearm section;

d. a grip which traverses the hand section; and e. at least one fastener;

wherein the hand section encloses a hand of a user and the hand of the user is enclosed about the grip to form a fist;

further wherein the hand section has a thumb opening and a knuckle opening therein;

further wherein the forearm section encloses a forearm of a user by means of an overlap section of the forearm section which is lapped over an underlap section of the forearm section and the overlap section is fastened upon the underlap section by at least a fastener; and further wherein a distal end of the unitary shell is closed with an end cap.

10. A protector as claimed in claim 9, further comprising a carrier opening in the forearm section.

11. A protector as claimed in claim 9, wherein the unitary shell is constructed of a material selected from the group consisting essentially of flexible, impact resistant plastic; carbon fiber; and aluminum.

12. A protector as claimed in claim 9, wherein the grip is constructed of a low temperature conduction material.

13. A protector as claimed in claim 9, wherein the grip and the inside of the unitary shell are padded.

14. A hand, wrist and forearm protector comprising:

a. a unitary shell; comprising b. a hand section; contiguous with c. a forearm section;

d. a grip which traverses the hand section; and e. at least one fastener;

wherein the hand section encloses a hand of a user and the hand of the user is enclosed about the grip to form a fist;

further wherein the hand section has a thumb opening, a knuckle opening and a finger opening therein;

further wherein the forearm section encloses a forearm of a user by means of an overlap section of the forearm section which is lapped over an underlap section of the forearm section and the overlap section is fastened upon the underlap section by at least a fastener;

further wherein a distal end of the unitary shell has a distal opening therein and a roll bar which spans the distal opening; and further wherein the distal end of the unitary shell has a finger opening therein.

15. A protector as claimed in claim 14, further comprising a carrier opening in the forearm section.

16. A protector as claimed in claim 14, wherein the unitary shell is constructed of a material selected from the group consisting essentially of flexible, impact resistant plastic; carbon fiber; and aluminum.

17. A protector as claimed in claim 14, wherein the grip is constructed of a low temperature conduction material.

18. A protector as claimed in claim 14, wherein the grip and the inside of the unitary shell are padded.

19. A protector as claimed in claim 14, wherein at least a friction, grasping device is attached to the roll bar.

* * * * *